US010859973B2

(12) United States Patent
Hommi et al.

(10) Patent No.: US 10,859,973 B2
(45) Date of Patent: Dec. 8, 2020

(54) IMAGE FORMING APPARATUS, IMAGE FORMING METHOD, AND RECORDING MEDIUM

(71) Applicants: Masashi Hommi, Kanagawa (JP); Tetsuya Hara, Tokyo (JP); Yuji Ieiri, Kanagawa (JP); Takumi Miyagawa, Tokyo (JP)

(72) Inventors: Masashi Hommi, Kanagawa (JP); Tetsuya Hara, Tokyo (JP); Yuji Ieiri, Kanagawa (JP); Takumi Miyagawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/821,175

(22) Filed: Mar. 17, 2020

(65) Prior Publication Data

US 2020/0301357 A1 Sep. 24, 2020

(30) Foreign Application Priority Data

Mar. 20, 2019 (JP) ..... 2019-052912

(51) Int. Cl.
*G03G 21/18* (2006.01)
*G03G 15/08* (2006.01)

(52) U.S. Cl.
CPC ..... *G03G 21/1892* (2013.01); *G03G 15/0856* (2013.01); *G03G 15/0865* (2013.01); *G03G 2215/0643* (2013.01); *G03G 2221/1892* (2013.01)

(58) Field of Classification Search
CPC ..... G03G 21/1892; G03G 15/0865; G03G 2215/0643; G03G 2221/1892
See application file for complete search history.

(56) References Cited

U.S. PATENT DOCUMENTS 4,963,939 A * 10/1990 Kurando ..... G03G 15/0863 335/203
5,075,724 A * 12/1991 Wada ..... G03G 15/0863 340/5.8

(Continued)

FOREIGN PATENT DOCUMENTS

| | | |
|---|---|---|
| JP | 2002-132038 | 5/2002 |
| JP | 2011-118144 | 6/2011 |
| JP | 2020-020888 | 2/2020 |

*Primary Examiner* — Francis C Gray
(74) *Attorney, Agent, or Firm* — IPUSA, PLLC

(57) ABSTRACT

An image forming apparatus including an electrode pair including two electrodes facing each other; a powder container interposed between the two electrodes and including a storage medium that is communicably coupled to the image forming apparatus; a capacitance detector configured to detect capacitance between the two electrodes; a powder container mounting determiner configured to determine whether the powder container is mounted to the image forming apparatus based on the capacitance, upon detecting that communication is not possible between the image forming apparatus and the storage medium; and an image forming execution controller configured to cause the image forming apparatus to execute image formation, upon determining, by the powder container mounting determiner, that the powder container is mounted to the image forming apparatus.

12 Claims, 11 Drawing Sheets

(56) References Cited

U.S. PATENT DOCUMENTS

| | | | | |
|---|---|---|---|---|
| 5,761,566 | A * | 6/1998 | Suzuki | B41J 2/17546 399/12 |
| 6,173,130 | B1 * | 1/2001 | Oguma | G03G 15/0822 399/254 |
| 6,311,025 | B1 * | 10/2001 | Nagata | G03G 15/0863 399/12 |
| 6,415,112 | B1 * | 7/2002 | Kimizuka | G03G 21/1814 399/27 |
| 8,463,144 | B2 * | 6/2013 | Yamamoto | G03G 21/1882 399/12 |
| 9,091,962 | B2 * | 7/2015 | Masui | G03G 15/0881 |
| 9,440,431 | B2 | 9/2016 | Hommi | |
| 9,757,940 | B2 | 9/2017 | Hommi | |
| 10,163,045 | B2 | 12/2018 | Tanaka et al. | |
| 10,459,368 | B2 | 10/2019 | Inokuchi et al. | |
| 2003/0123888 | A1 * | 7/2003 | Naito | G03G 15/0856 399/27 |
| 2018/0239274 | A1 * | 8/2018 | Motohashi | G03G 15/0865 |
| 2020/0033752 | A1 | 1/2020 | Kubo et al. | |

* cited by examiner

FIG.14

| CASE NUMBER | COMMUNICATION STATE OF ID CHIP | DIFFERENCE IN CAPACITANCE DATA BEFORE AND AFTER ATTACHING/DETACHING TONER CONTAINER | IMAGE FORMING OPERATION |
|---|---|---|---|
| 1 | COMMUNICATING | LESS THAN OR EQUAL TO ±15% | PERFORM OPERATION |
| 2 | COMMUNICATING | GREATER THAN ±15% | PERFORM OPERATION |
| 3 | UNABLE TO COMMUNICATE | LESS THAN OR EQUAL TO ±15% | PERFORM OPERATION |
| 4 | UNABLE TO COMMUNICATE | GREATER THAN ±15% | DO NOT PERFORM OPERATION |

IMAGE FORMING APPARATUS, IMAGE FORMING METHOD, AND RECORDING MEDIUM

CROSS-REFERENCE TO RELATED APPLICATION

The present application is based on and claims priority under 35 U.S.C. § 119 to Japanese Patent Application No. 2019-052912, filed on Mar. 20, 2019, the contents of which are incorporated herein by reference in their entirety.

BACKGROUND OF THE INVENTION

1. Field of the Invention

The present invention relates to an image forming apparatus, an image forming method, and a recording medium.

2. Description of the Related Art

In the related art, there is a known technique in which a storage medium is mounted to a unit that includes one or more replacement parts and that can be detachably attached to a main unit of an apparatus, and by appropriately updating information stored in the storage medium such as the usage history of the parts, the replacement timing of the parts and the like is managed.

Further, there is an apparatus in which, when communication between a unit and a storage medium is abnormal, the data to be communicated with the unit is temporarily stored in a non-volatile memory included in a main unit of the apparatus, so as to reduce the downtime of the apparatus without stopping the apparatus (see, for example, Patent Document 1).

Patent Document 1: Japanese Unexamined Patent Application Publication No. 2011-118144

SUMMARY OF THE INVENTION

According to one aspect of the present invention, there is provided an image forming apparatus including an electrode pair including two electrodes facing each other; a powder container interposed between the two electrodes and including a storage medium that is communicably coupled to the image forming apparatus; a capacitance detector configured to detect capacitance between the two electrodes; a powder container mounting determiner configured to determine whether the powder container is mounted to the image forming apparatus based on the capacitance, upon detecting that communication is not possible between the image forming apparatus and the storage medium; and an image forming execution controller configured to cause the image forming apparatus to execute image formation, upon determining, by the powder container mounting determiner, that the powder container is mounted to the image forming apparatus.

BRIEF DESCRIPTION OF THE DRAWINGS

FIG. 14 is a diagram illustrating an example of a relationship between the communication state of an ID chip, the difference in the capacitance data before and after the attaching/detaching of the toner container, and an image forming operation according to the second embodiment of the present invention.

DETAILED DESCRIPTION OF THE PREFERRED EMBODIMENTS

Figure 1:
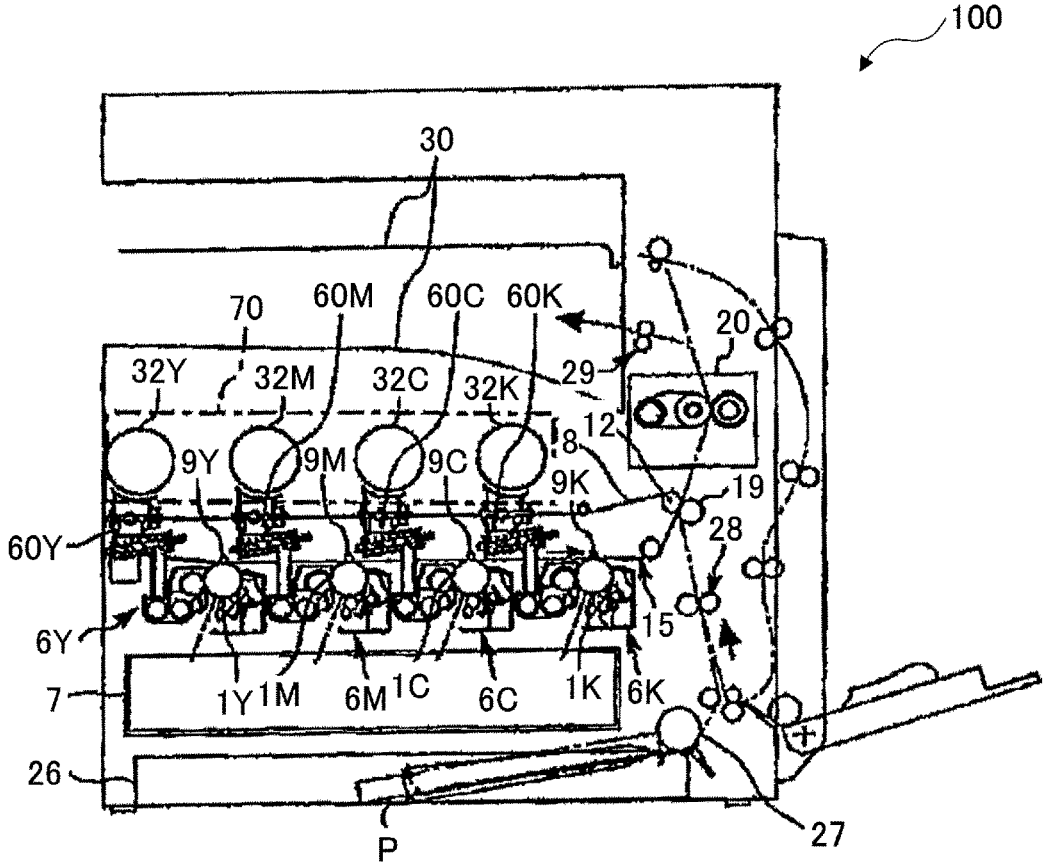
FIG. 1 is a diagram illustrating an example of a configuration of an image forming apparatus according to an embodiment of the present invention.

With respect to the apparatus of Patent Document 1, when the unit such as a powder container and the like is attached to/detached from the main unit of the apparatus such as an image forming apparatus, and the main unit of the apparatus is unable to communicate with the storage medium at the time when the main unit of the apparatus starts communication with the storage medium, the apparatus cannot determine whether communication is not possible because the powder container is not mounted to the main unit of the apparatus, or the powder container is mounted to the main unit of the apparatus but communication is not possible due to a communication abnormality. Therefore, there have been cases where the powder container is not mounted to the main unit of the apparatus, but image formation is executed even though image formation is not possible. In this case, an image cannot be properly formed.

A problem to be addressed by an embodiment of the present invention is to appropriately execute image formation even when the main unit of the apparatus and the storage medium are unable to communicate with each other.

Hereinafter, an embodiment for carrying out the present invention will be described with reference to the drawings. In the drawings, the same elements are denoted by the same reference numerals and overlapping descriptions may be omitted.

The recording medium in the embodiment is a paper sheet, a plastic sheet, and the like. Hereinafter, the case where the recording medium is a paper sheet and the powder is a toner, will be described as an example.

Note that in the embodiment, it is assumed that terms such as image forming, printing, and character printing are synonymous.

<Configuration of Image Forming Apparatus According to Embodiment>

FIG. 1 is a diagram illustrating an example of a configuration of an image forming apparatus 100 according to an embodiment. The image forming apparatus 100 includes a toner container (powder container) accommodating unit 70, an intermediate transfer unit 15, an image forming unit 6, and a toner supplying unit 60. In the toner container accommodating unit 70, four toner containers 32 (Y, M, C, and K), each corresponding to one of the colors (yellow, magenta, cyan, and black), are detachably attached (replaceable).

In FIG. 1, the intermediate transfer unit 15 is provided below the toner container accommodating unit 70. The image forming units 6 (Y, M, C, and K), each corresponding to one of the colors, are arranged in parallel so as to face an intermediate transfer belt 8 of the intermediate transfer unit 15.

Below the toner containers 32 (Y, M, C, and K), the toner supplying units 60 (Y, M, C, and K) are provided, respectively. The toner contained in the toner containers 32 (Y, M, C, and K) is supplied, by the toner supplying units 60 (Y, M, C, and K), respectively, to a developing unit 5 (see FIG. 2) in each of the image forming units 6 (Y, M, C, and K).

The four toner containers 32 (Y, M, C, and K), the image forming units 6 (Y, M, C, and K), and the toner supplying units 60 (Y, M, C, and K) corresponding to the respective colors have the same configuration except that the colors of the toner to be used are different. Therefore, in the following description and drawings, the subscripts "Y", "M", "C", and "K", each representing the color of the toner to be used, are omitted as appropriate.

Figure 2:
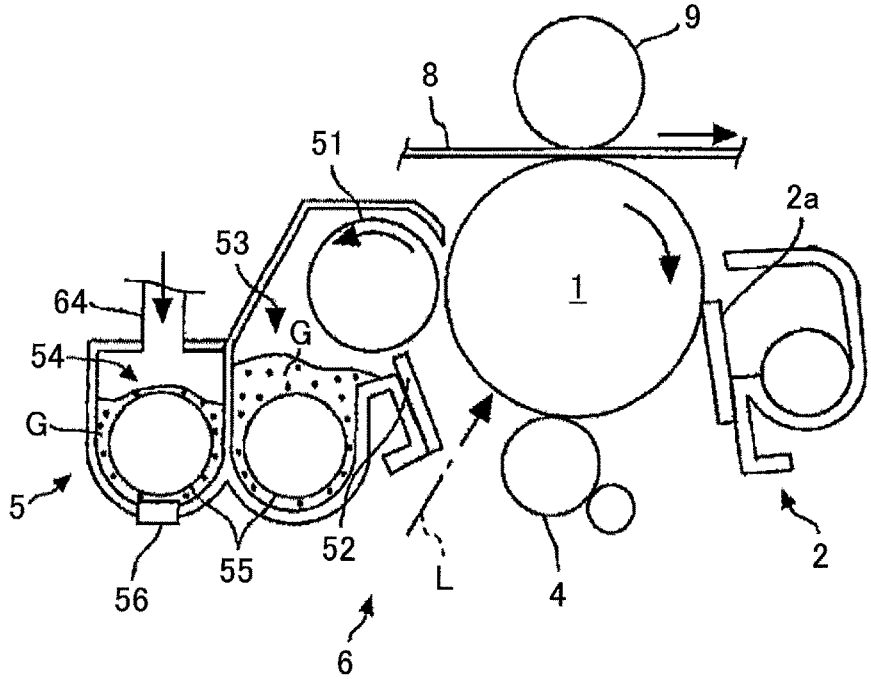
FIG. 2 is a diagram illustrating an example of a configuration of an image forming unit according to an embodiment of the present invention.

FIG. 2 is a diagram illustrating an example of a configuration of one of the four image forming units 6. The image forming unit 6 includes a photoconductor 1, a charging unit 4 disposed around the photoconductor 1, the developing unit 5, a cleaning unit 2, and a discharging unit. An image of each color is formed on the photoconductor 1 by performing an image forming process on the photoconductor 1, that is, a charging process, an exposure process, a developing process, a transfer process, and a cleaning process.

The photoconductor 1 is driven to rotate in the direction (the clockwise direction) of the arrow illustrated in the photoconductor 1 of FIG. 2, by a driving motor. At the position of the charging unit 4, the surface of the photoconductor 1 is uniformly charged (charging process). Subsequently, the surface of the photoconductor 1 (a particular portion on the surface of the photoconductor 1) reaches an irradiation position of a laser light L emitted from an exposure unit 7, and at this position, an electrostatic latent image corresponding to each color is formed by exposure scanning (exposure process).

Subsequently, the surface of the photoconductor 1 reaches a position facing the developing unit 5, and at this position, the electrostatic latent image is developed, so that a toner image of each color is formed (developing process). Subsequently, the surface of the photoconductor 1 reaches a primary transfer portion facing a primary transfer roller 9 with the intermediate transfer belt 8 sandwiched between the primary transfer roller 9 and the photoconductor 1, and at this primary transfer portion, the toner image on the photoconductor 1 is transferred onto the intermediate transfer belt 8 (primary transfer process). The toner image of each color formed on the photoconductor 1 of each color is transferred onto the intermediate transfer belt 8 to be superimposed, so that a color image is formed on the intermediate transfer belt 8.

On the surface of the photoconductor 1 that has passed through the primary transfer portion, a small amount of untransferred toner remains. Subsequently, the surface of the photoconductor 1 reaches a position facing the cleaning unit 2, and the untransferred toner remaining on the photoconductor 1 is mechanically collected by a cleaning blade 2*a* (cleaning process). Finally, the surface of the photoconductor 1 reaches a position facing the discharging unit and the residual potential on the photoconductor 1 is removed.

The intermediate transfer unit 15 includes the intermediate transfer belt 8, four primary transfer rollers 9 (Y, M, C, and K), a secondary transfer backup roller 12, a plurality of tension rollers, and an intermediate transfer cleaning unit. The intermediate transfer belt 8 is stretched and supported by a plurality of stretching rollers. Also, the intermediate transfer belt 8 is endlessly moved in the direction (the counter-clockwise direction) of the arrow indicated at the intermediate transfer belt 8 of FIG. 1 by the rotational driving of the secondary transfer backup roller 12 among the roller members. Each of the four primary transfer rollers 9 (Y, M, C, and K) forms a primary transfer nip by sandwiching the intermediate transfer belt 8 with the corresponding photoconductor 1 (Y, M, C, and K).

Then, a transfer bias opposite to the polarity of the toner is applied to the primary transfer roller 9 (Y, M, C, and K). The intermediate transfer belt 8 moves in the direction of the arrow indicated at the intermediate transfer belt 8 of FIG. 1 and sequentially passes through the primary transfer nips of the primary transfer rollers 9 (Y, M, C, and K). Accordingly, the toner images of the respective colors on the photoconductor 1 (Y, M, C, and K) are transferred to and superimposed on the intermediate transfer belt 8 (primary transfer).

The intermediate transfer belt 8 on which the toner images of the respective colors have been transferred and superimposed (primary transfer), reaches a secondary transfer portion facing a secondary transfer roller 19. At the secondary transfer portion, the intermediate transfer belt 8 is sandwiched between the secondary transfer backup roller 12 and the secondary transfer roller 19 to form a secondary transfer nip. The toner images of the four colors formed on the intermediate transfer belt 8 are transferred (secondary transfer) onto a recording medium P, such as a transfer sheet, conveyed to the position of the secondary transfer nip.

At this time, untransferred toner, that has not been transferred to the recording medium P, remains on the intermediate transfer belt 8. Subsequently, the intermediate transfer belt 8 reaches the position of the intermediate transfer cleaning unit and the untransferred toner on the intermediate transfer belt 8 is collected. In this way, a series of transfer processes performed on the intermediate transfer belt 8 is completed.

The recording medium P conveyed to the position of the secondary transfer nip, is the recording medium P that has been conveyed from a sheet feeding unit 26 disposed at the lower portion of the image forming apparatus 100 via a sheet feeding roller 27, a pair of registration rollers 28, and the like. Specifically, a plurality of pieces of the recording media P are stacked in the sheet feeding unit 26. When the sheet feeding roller 27 is driven to rotate in the counter-clockwise direction in FIG. 1, the recording medium P at the very top is fed towards a portion between the rollers of the pair of registration rollers 28.

The recording medium P conveyed to the pair of registration rollers 28 temporarily stops at the roller nip of the pair of registration rollers 28 that has stopped the rotational driving. Then, the pair of registration rollers 28 is driven to rotate at a timing so as to coincide with the color image on the intermediate transfer belt 8, and the recording medium P is conveyed toward the secondary transfer nip. In this way, a desired color image is transferred onto the recording medium P.

The recording medium P on which the color image has been transferred at the secondary transfer nip, is conveyed to a fixing unit 20. Then, at this position, the color image that has been transferred to the surface of the recording medium P is fixed to the recording medium P by heat and pressure applied by a fixing belt and a pressure roller.

Subsequently, the recording medium P passes through the rollers of a pair of paper ejection rollers 29 and is ejected to the outside of the apparatus. The recording medium P ejected outside the apparatus by the pair of paper ejection rollers 29 is sequentially stacked on a stack unit 30 as an output image. In this way, a series of image forming processes in the image forming apparatus 100 is completed.

Next, the configuration and operation of the developing unit in the image forming unit will be described in further detail.

As illustrated in FIG. 2, the developing unit 5 includes a developing roller 51 facing the drum-shaped photoconductor 1, a doctor blade 52 facing the developing roller 51, and two conveying screws 55 disposed in a first developer accommodating unit 53 and a second developer accommodating unit 54, respectively. Further, a toner density detecting sensor 56 for detecting the toner density in the developer of the first developer accommodating unit 53 is provided.

The developing roller 51 includes a magnet fixed to the inside, a sleeve rotating around the magnet, and the like. A two-component developer G formed of carriers and a toner is contained in first and second developer accommodating units 53 and 54. The second developer accommodating unit 54 is in communication with a toner dropping conveying path 64 via an opening formed above the second developer accommodating unit 54.

The sleeve of the developing roller 51 is driven to rotate in the direction (the counterclockwise direction) of the arrow indicated in the developing roller 51 in FIG. 2. The developer G, which is carried on the developing roller 51 by a magnetic field formed by the magnet, moves on the developing roller 51 as the sleeve rotates.

The developer G in the developing unit 5 is adjusted so that the ratio of the toner in the developer (toner density) is within a predetermined range. In accordance with the toner consumption in the developing unit 5, the toner contained in the toner container 32 is supplied to the second developer accommodating unit 54 via the toner supplying unit 60. The configuration and operations of the toner supplying unit 60 will be described in detail below.

The toner supplied in the second developer accommodating unit 54 circulates through the first and second developer accommodating units 53 and 54 while being mixed and stirred with the developer G by the two conveying screws 55. Then, the toner in the developer G is attracted to the carriers by frictional charging with the carriers, and is carried on the developing roller 51 together with the carriers by magnetic force formed on the developing roller 51. The developer G carried on the developing roller 51 is conveyed in the direction of an arrow indicated in the developing roller 51 in FIG. 2 to reach the position of the doctor blade 52.

Then, at the position of the doctor blade 52, the amount of the developer G on the developing roller 51 is optimized, and subsequently, the developer G on the developing roller 51 is conveyed to a position facing the photoconductor 1 (the developing area), and the toner is attracted to a latent image formed on the photoconductor 1 by an electric field formed in the developing area. Subsequently, the developer G remaining on the developing roller 51 reaches the upper portion of the first developer accommodating unit 53 according to the rotation of the sleeve, and at this position, the developer G is separated from the developing roller 51.

Next, the toner supplying unit 60 and the toner container 32 will be described in detail.

Figure 3:
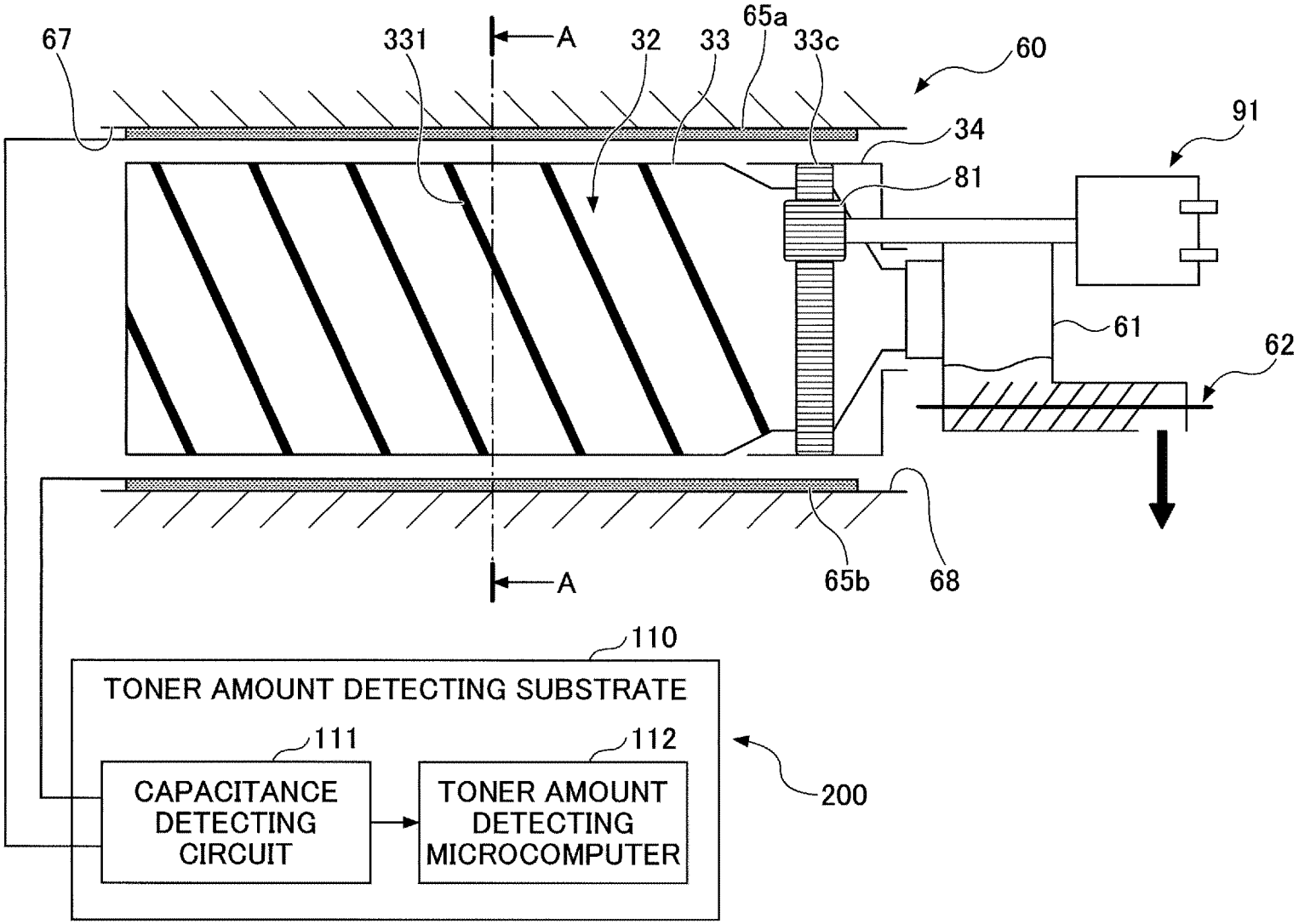
FIG. 3 is a diagram illustrating an example of a configuration of a toner supplying unit according to an embodiment of the present invention.
Figure 4:
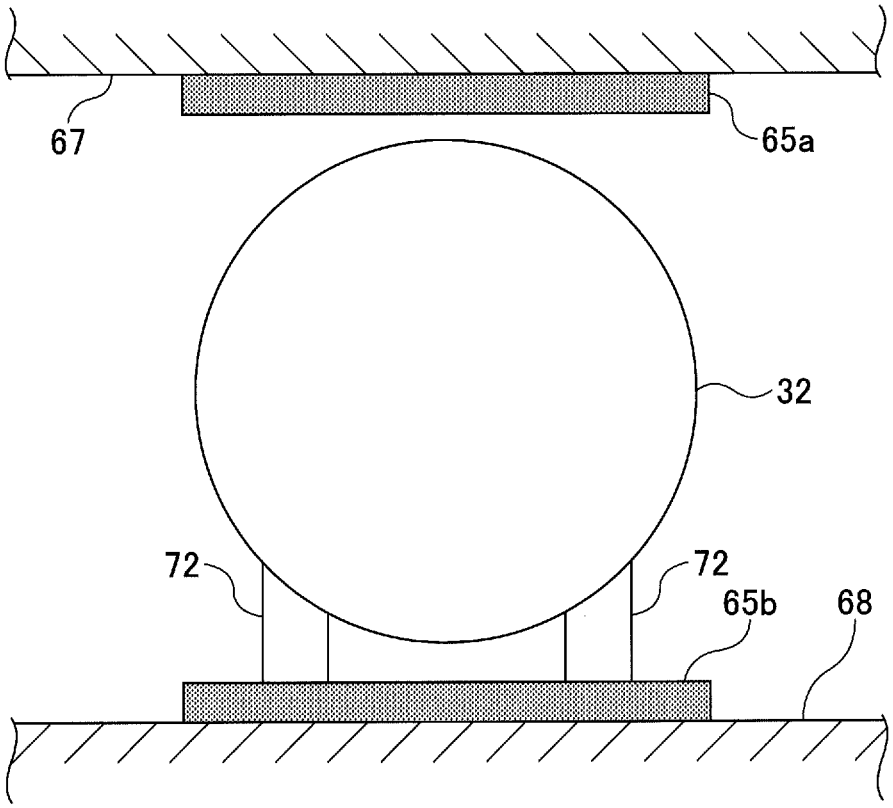
FIG. 4 is a cross-sectional view of A-A in FIG. 3 according to an embodiment of the present invention.

FIG. 3 is a diagram illustrating an example of a configuration of one of the four toner supplying units 60. FIG. 4 is a cross-sectional view of A-A in FIG. 3, and FIG. 5 is a perspective view illustrating an example in which the toner containers 32 (Y, M, C, and K) are installed in the toner container accommodating unit 70.

The toner in the toner container 32 installed in the toner container accommodating unit (see FIG. 1) of the image forming apparatus 100 is appropriately supplied to the developing unit 5 of each color by the toner supplying unit 60 provided for each color in accordance with the toner consumption in the developing unit 5 of each color.

Figure 5:
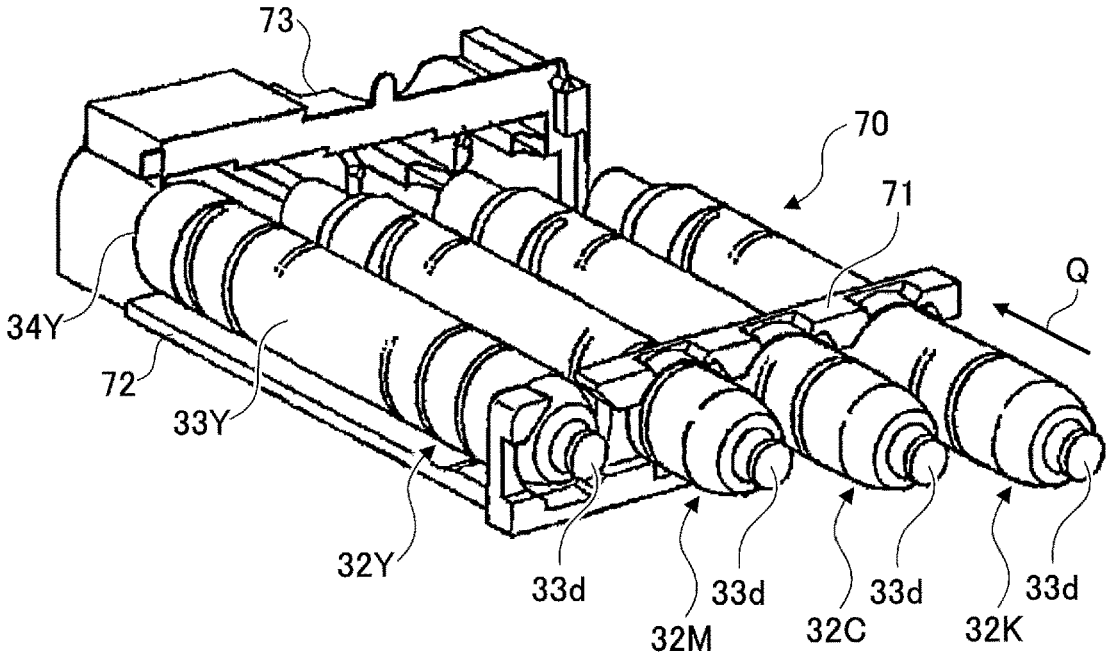
FIG. 5 is a perspective view illustrating an example in which toner containers are installed in a toner container accommodating unit according to an embodiment of the present invention.

The toner container 32 can be mounted to the toner container accommodating unit 70 by moving the toner container 32 in the direction of an arrow "Q" in FIG. 5 with respect to the toner container accommodating unit 70 of the main unit of the image forming apparatus 100 (also referred to as an "apparatus main unit").

The toner container 32 is supported by two guide units 72 illustrated in FIG. 4. The toner container 32 is a substantially cylindrical toner bottle having a cap 34 held in a non-rotational manner by the toner container accommodating unit 70 and a container main unit 33 with which a gear 33*c* is integrally formed, as illustrated in FIG. 3.

The container main unit 33 is rotatably retained relative to the cap 34 so that the gear 33*c* is able to engage with a drive output gear 81 of the toner supplying unit 60. When a driving motor 91 rotates the drive output gear 81, a driving force is transmitted to the gear 33*c* of the container main unit 33, and while the outer peripheral surface of the container main unit 33 is guided by the guide units 72 (see FIG. 5), the container main unit 33 can be driven to rotate.

As the container main unit 33 rotates, the toner contained within the container main unit 33 is conveyed from the left side to the right side in FIG. 3 along the longitudinal direction of the container main unit 33 by a spiral protrusion 331 formed in a spiral manner on the inner peripheral surface of the container main unit 33.

The conveyed toner is discharged from the toner container 32 and supplied into a hopper unit 61 of the toner supplying unit 60. That is, when the container main unit 33 of the toner container 32 is rotatably driven by the driving motor 91 as appropriate, the toner is supplied to the hopper unit 61 as appropriate. The toner container 32 (Y, M, C, and K) of each color is replaced with a new toner container when the toner container 32 reaches the life span thereof, for example, when almost all of the toner contained in the toner container 32 is consumed and the toner container 32 becomes empty.

As illustrated in FIG. 3, the toner supplying unit 60 includes the hopper unit 61, a toner conveying screw 62, and the driving motor 91. In the hopper unit 61, the toner supplied from the toner container 32 is stored, and the hopper unit 61 is provided with the toner conveying screw 62.

When a control unit detects that the toner density inside the developing unit 5 has decreased based on the detection result of the toner density detecting sensor 56 (see FIG. 2), the toner supplying unit 60 rotates the toner conveying screw 62 for a predetermined time to supply toner to the developing unit 5. The toner can be supplied by rotating the toner conveying screw 62, and, therefore, by detecting the number of rotations of the toner conveying screw 62, it is possible to accurately calculate the toner supply amount supplied to the developing unit 5.

On the wall of the hopper unit 61, a toner end sensor is installed for detecting that the toner stored in the hopper unit 61 has become less than or equal to a predetermined amount. As the toner end sensor, a piezoelectric sensor and the like can be used. When the toner stored in the hopper unit 61 is detected to be less than or equal to a predetermined amount by the toner end sensor (toner end detection), the driving motor 91 starts driving. Then, the container main unit 33 of the toner container 32 is driven to rotate for a predetermined time to supply toner to the hopper unit 61.

In the embodiment, the hopper unit 61 is provided to temporarily store the toner discharged from the toner container 32, but the toner discharged from the toner container 32 may be directly supplied to the developing unit 5.

Here, there is a known method in the related art of predicting the toner amount in the toner container 32 and reporting the amount to the user and the like. As the method of predicting the toner amount in the toner container 32, there is a method of predicting the amount from the accumulated driving time of the toner conveying screw 62. The toner conveying amount conveyed by the toner conveying screw 62 is substantially proportional to the rotation angle (rotation time), and, therefore, by recording the total rotation time of the toner conveying screw 62, the toner usage amount can be known, and by subtracting the toner usage amount from the initial fill amount of the toner container 32, the toner amount can be known. However, the conveying amount of the toner conveying screw 62 varies depending on the environment, the driving time, the supplying frequency (supplying intervals), and the like, and, therefore, the prediction of the toner amount is highly variable.

Further, as another method of predicting the toner amount of the toner container 32, there is a method of predicting the toner amount by an output image pattern. The toner amount used for the image that is printed out (the toner amount adhering to the photoconductor per image area is substantially constant) can be calculated, and, therefore, if the accumulated image area is known, the toner usage amount can be known. However, in this method also, the toner adhering to the photoconductor varies due to various errors, and, therefore, it is difficult to recognize the accurate toner amount.

<Configuration of Toner Amount Detecting Apparatus According to Embodiment>

Here, the configuration of the toner amount detecting apparatus according to the embodiment will be described in further detail with reference to FIGS. 3 and 4.

As illustrated in FIG. 3, a toner amount detecting apparatus 200 includes a pair of parallel plate electrodes 65*a* and 65*b* and a toner amount detecting substrate 110. Further, the toner amount detecting substrate 110 includes a capacitance detecting circuit 111 and a toner amount detecting microcomputer 112. The parallel plate electrodes 65*a* and 65*b* and the capacitance detecting circuit 111 are provided for each toner container of each color, and the toner amount detecting microcomputer 112 is commonly used for all of the colors. However, the toner amount detecting microcomputer 112 may be provided for each color.

As illustrated in FIGS. 3 and 4, the toner container 32 is sandwiched between the two parallel plate electrodes 65*a* and 65*b* from the outside of the toner container 32, such that the two parallel plate electrodes 65*a* and 65*b* cover substantially the entire toner container 32. Here, the parallel plate electrodes 65*a* and 65*b* are an example of an "electrode pair (two electrodes)". Note that hereinafter, the parallel plate electrodes 65*a* and 65*b* are referred to as the parallel plate electrode 65, when the parallel plate electrodes 65*a* and 65*b* are not particularly distinguished from each other.

The length of the parallel plate electrode 65 in the shorter direction (the length in the left-right direction in FIG. 4) is longer than the diameter of the toner container 32, and the length of the parallel plate electrode 65 in the longitudinal direction (the length in the left-right direction in FIG. 3) is greater than or equal to half the length of the toner container.

The parallel plate electrode 65*a* is fixed by double-sided tape and the like to an upper wall 67 of the image forming apparatus 100 facing the toner container 32 from above the toner container 32. Further, the parallel plate electrode 65*b* is fixed by double-sided tape and the like to a lower wall 68 of the image forming apparatus 100 facing the toner container 32 from under the toner container 32. The parallel plate electrode 65 may be any electrically conductive member, and in the embodiment, the parallel plate electrode 65 is a plate member made of iron.

The two parallel plate electrodes 65*a* and 65*b* have the same size. By making the two parallel plate electrodes 65*a* and 65*b* have the same size, it will be possible to reduce a variation in the density of the electric force lines between the parallel plate electrodes, and it will be possible to prevent a variation in the capacitance that may be caused by the uneven distribution of the toner present in the toner container 32 even when the toner amount is unchanged.

The parallel plate electrodes 65*a* and 65*b* are each electrically coupled to the capacitance detecting circuit 111. By applying power from the capacitance detecting circuit 111 to the two parallel plate electrodes 65*a* and 65*b*, it is possible to detect the capacitance between the parallel plate electrodes 65*a* and 65*b*.

The method for detecting the capacitance may be a general method, and in the embodiment, the capacitance is detected by a charging method (applying a constant voltage or a constant current between the electrodes and detecting the capacitance based on the relationship between the time to the charge reaching point and the voltage or the current).

The detected capacitance varies according to the dielectric constant between the parallel plate electrodes 65*a* and 65*b*. The dielectric constant of the toner is higher than that of air, and, therefore, the dielectric constant varies depending on the toner amount in the range of the electric field between the parallel plate electrodes. Therefore, the capacitance varies depending on the toner amount in the toner container 32 sandwiched from the outside by the parallel plate electrodes 65*a* and 65*b*. The capacitance detecting circuit 111 outputs detected capacitance data between the parallel plate electrodes to the toner amount detecting microcomputer 112.

The toner amount detecting microcomputer 112 can acquire the toner amount in the toner container 32 by referring to a calibration curve indicating the relationship between the capacitance and the toner amount acquired in advance, based on the input capacitance data.

Figure 6:
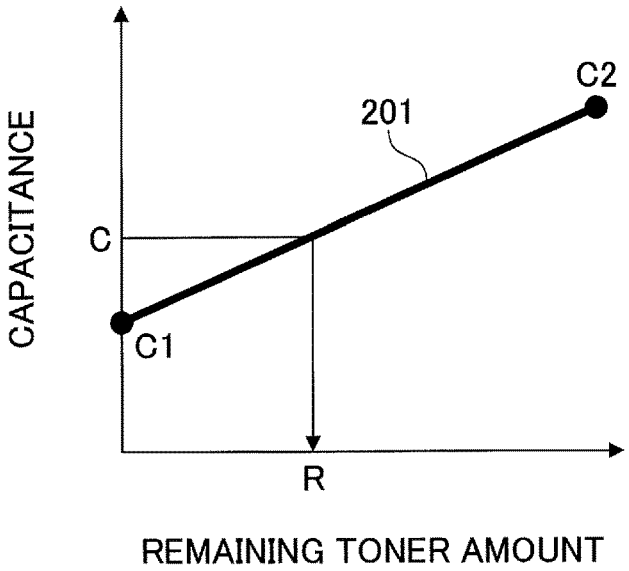
FIG. 6 is a diagram illustrating an example of a calibration curve according to an embodiment of the present invention.

FIG. 6 is a diagram illustrating an example of a calibration curve. The horizontal axis of FIG. 6 indicates the toner amount and the vertical axis of FIG. 6 indicates the capacitance. When the toner amount detecting apparatus 200 acquires a calibration curve 201, the toner amount detecting apparatus 200 detects a capacitance C1 when the toner container 32 is empty, that is, when the toner amount inside the toner container 32 is zero, and a capacitance C2 when the toner container 32 is full. Then, a primary expression including the capacitance C1 and the capacitance C2 is obtained, and the calibration curve 201 can be acquired by associating the capacitance with the toner amount according to the primary expression.

However, the state of the toner amount when acquiring the calibration curve 201 is not limited to the time when the toner container 32 is empty and the time when the toner container 32 is full. The calibration curve 201 may be acquired from the capacitance at two or more states in which the toner amount in the toner container 32 is known.

Figure 7:
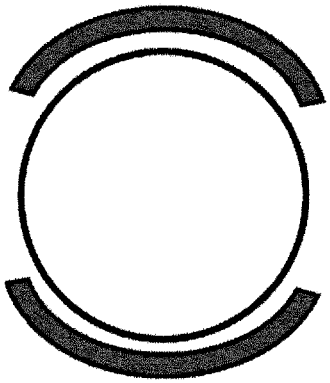
FIG. 7 is a cross-sectional view illustrating an example in which each electrode included in a pair of electrodes is formed into an arc shape along an outer peripheral surface of a toner container according to an embodiment of the present invention.

Further, in the embodiment, the two electrodes are parallel plates. By making the two electrodes parallel plates, an accurate amount of toner can be detected, compared to the case where the two electrodes have an arc shape along the outer peripheral surface of the toner container as illustrated in FIG. 7

Figure 8A:
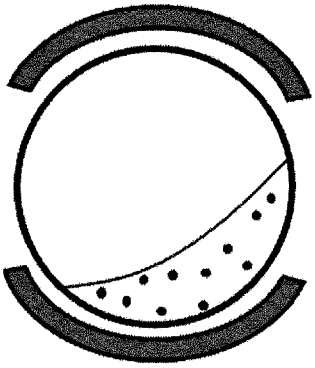
FIGS. 8A and 8B are cross-sectional views illustrating a failure that occurs when the two electrodes are formed to have an arc shape according to an embodiment of the present invention.
Figure 8B:
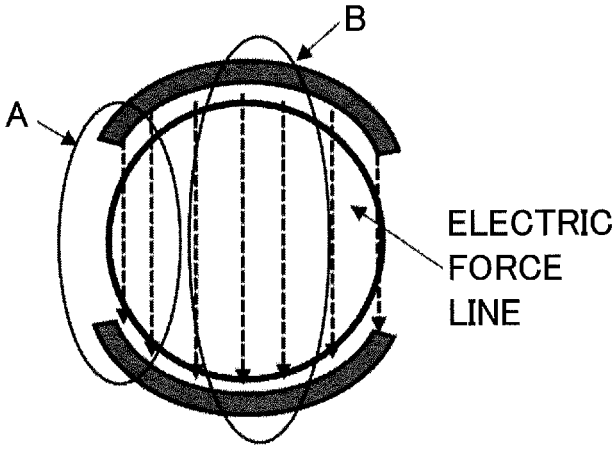

FIGS. 8A and 8B are schematic cross-sectional views illustrating a failure that occurs when the two electrodes are formed to have an arc shape. As illustrated in FIG. 8A, the toner T in the toner container 32 may have various shapes in a cross section perpendicular to the rotational axis direction of the toner container, such as a shape in which the toner is unevenly distributed or a shape in which the toner is evenly distributed. When the two electrodes have an arc shape, as illustrated in FIG. 8B, the distance between the end portions of the respective electrodes will be shorter than the distance between the center portions of the respective electrodes. As a result, the density of the electric force lines in an area A at the end portions of the respective electrodes is higher than the density of the electric force lines in an area B at the center portions of the respective electrodes. Accordingly, even when the height of the toner is the same on the left and on the right as viewed in the figure, the capacitance in the area A where the density of electric force lines is high and the capacitance in the area B where the density of electric force lines is low, will be different. As a result, the capacitance will differ between the case where the toner is unevenly distributed and the case where the toner is evenly distributed even when the amount of the toner is the same, and, therefore, it may not be possible to detect an accurate amount of toner.

On the other hand, in the present embodiment, the two electrodes are made to be parallel plates, and, therefore, the electric force lines between the electrodes can be uniform. Accordingly, there will be no instances where capacitance differs between the case where the toner is unevenly distributed and the case where the toner is evenly distributed, so that the toner amount can be accurately detected.

<Hardware Configuration of Image Forming Apparatus According to Embodiment>

Figure 9:
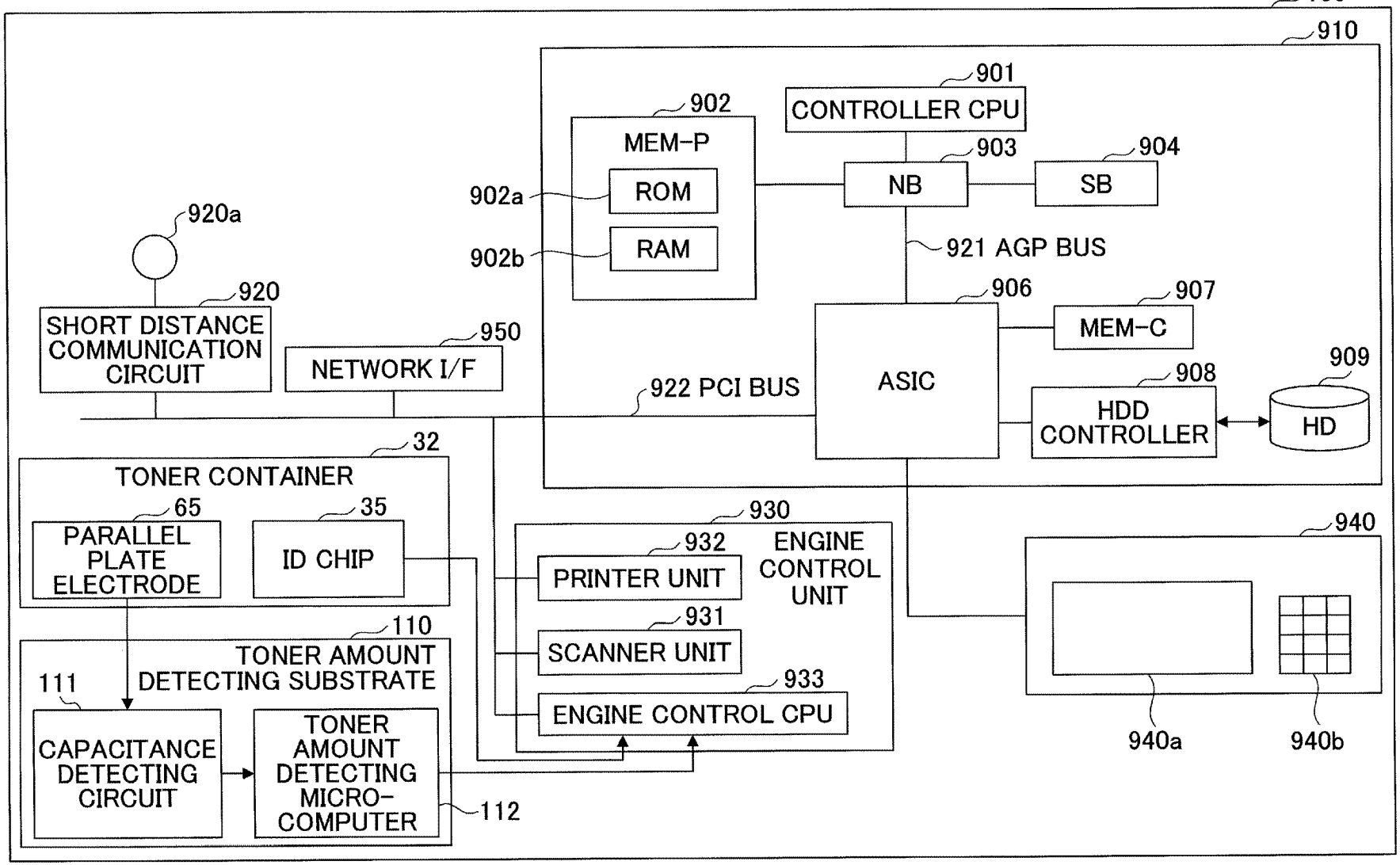
FIG. 9 is a block diagram illustrating an example of a hardware configuration of an image forming apparatus according to an embodiment of the present invention.

Next, the hardware configuration of the image forming apparatus 100 will be described with reference to FIG. 9. FIG. 9 is a block diagram illustrating an example of the hardware configuration of the image forming apparatus 100 according to the present embodiment.

As illustrated in FIG. 3, the image forming apparatus 100 includes a controller 910, a short distance communication circuit unit 920, an engine control unit 930, an operation panel 940, and a network interface (I/F) 950.

Among these, the controller 910 includes a controller central processing unit (CPU) 901 as a main part of a computer, a system memory (MEM-P) 902, a North Bridge (NB) 903, a South Bridge (SB) 904, an Application Specific Integrated Circuit (ASIC) 906, a local memory (MEM-C) 907 as a storage unit, a hard disk drive (HDD) controller 908, and a hard disk (HD) 909 as a storage unit. Further, the NB 903 and the ASIC 906 are coupled by an Accelerated Graphics Port (AGP) bus 921.

Among these, the controller CPU 901 is a control unit that performs overall control of the image forming apparatus 100. The NB 903 is a bridge for coupling the controller CPU 901 to the MEM-P 902, the SB 904, and the AGP bus 921, and the NB 903 includes a memory controller for controlling reading and writing to the MEM-P 902, a Peripheral Component Interconnect (PCI) master, and an AGP target.

The MEM-P 902 includes a read-only memory (ROM) 902*a*, which is a memory for storing programs and data for implementing functions of the controller 910, and a random access memory (RAM) 902*b*, which is used for expanding programs and data and as a rendering memory at the time of memory printing.

Note that the program stored in the RAM 902*b* may be provided by being recorded in a computer-readable recording medium such as a Compact Disk Read-Only Memory (CD-ROM), a CD recordable (CD-R), a digital versatile disc (DVD) or the like, in a file of an installable format or an executable format.

The SB 904 is a bridge for coupling the NB 903 with PCI devices and peripheral devices. The ASIC 906 is an integrated circuit (IC) for image processing purposes including hardware elements for image processing, and serves as a bridge for coupling the AGP bus 921, the PCI bus 922, the HDD controller 908, and the MEM-C 907, respectively.

The ASIC 906 includes a PCI target and an AGP master, an arbitrator (ARB) that forms the core of the ASIC 906, a memory controller that controls the MEM-C 907, a plurality of Direct Memory Access Controllers (DMACs) that perform image data rotation and the like by hardware logic and the like, and a PCI unit that performs data transfer between a scanner unit 931 and a printer unit 932 via a PCI bus 922.

Note that the ASIC 906 may be coupled to an interface of a Universal Serial Bus (USB) or an interface of the Institute of Electronic and Electronic Engineers 1394 (IEEE 1394).

The MEM-C 907 is a local memory used as an image buffer and a code buffer for copying. The HD 909 is a storage device for storing image data, for storing font data used at the time of printing, and for storing forms. The HDD controller 908 controls the reading or writing of data to the HD 909 according to the control of the controller CPU 901.

The AGP bus 921 is a bus interface proposed for graphics accelerator cards to speed up graphics processing, and by directly accessing the MEM-P 902 with high throughput, the graphics accelerator card can be made faster.

Further, the short distance communication circuit unit 920 is provided with a short distance communication circuit 920*a*. The short distance communication circuit 920*a* is a communication circuit such as Near Field Communication (NFC), Bluetooth (registered trademark), etc.

The engine control unit 930 further includes the scanner unit 931, the printer unit 932 and an engine control CPU 933. The operation panel 940 includes a panel display unit 940*a*, such as a touch panel, which displays the current setting value or a selection screen and which accepts input from an operator, and an operation unit 940*b*, including a numeric pad for accepting setting values of image forming conditions such as a density setting condition, a start key for accepting a copy start instruction, and the like.

The controller 910 controls the entire image forming apparatus 100 and controls, for example, rendering, communication, input from the operation panel 940, and the like. The scanner unit 931 or the printer unit 932 includes an image processing portion such as error diffusion, gamma conversion, and the like.

The engine control CPU 933 controls the entire engine for image formation. The engine control CPU 933 may include a part of or all of the control functions of the scanner unit 931 and the printer unit 932.

Note that in the image forming apparatus 100, by using an application switching key of the operation panel 940, it is possible to sequentially switch and select the functions among a document box function, a copy function, a printer function, and a facsimile function.

When the document box function is selected, the document box mode is set, when the copy function is selected, the copy mode is set, when the printer function is selected, the printer mode is set, and when the facsimile function is selected, the facsimile mode is set.

The network I/F 950 is an interface for performing data communication using a network. The short distance communication circuit unit 920 and the network I/F 950 are electrically coupled to the ASIC 906 via the PCI bus 922.

Here, the image forming apparatus 100 includes the toner container 32 as described above, and the toner container 32 of each color includes the parallel plate electrodes 65 and an identification (ID) chip 35. The ID chip 35 is a semiconductor chip that stores inside the identification number of the toner container, the color of the toner, the manufacturing lot of the toner, the remaining amount of toner, and the like. The ID chip 35 is coupled to the engine control CPU 933 so as to be capable of serial communication via the I-squared-C (I2C), the Serial Peripheral Interface (SPI), and the like. Here, the ID chip 35 is an example of a "storage medium".

The engine control CPU 933 communicates with the ID chip 35 to read and/or write the identification number of the toner container, the color of the toner, the manufacturing lot of the toner, the remaining amount of the toner, and the like stored in the ID chip 35.

Pieces of information such as the identification number of the toner container, the toner usage history, and the like read by the engine control CPU 933, are stored in association with each other in the HD 909 and the like. The controller 910 can acquire information such as the toner usage history in the toner container by referring to the HD 909 and the like based on an identification number and the like. This information can be used to control the replacement timing of the toner container.

The toner amount detecting microcomputer 112 acquires the toner amount in the toner container 32 and outputs the toner amount to the engine control CPU 933. The toner amount detecting microcomputer 112 can output the capacitance data, input from the capacitance detecting circuit 111, to the engine control CPU 933. However, the engine control CPU 933 may input capacitance data from the capacitance detecting circuit 111.

The configuration of the toner amount detecting substrate 110 has been described above in detail, and, therefore, overlapping descriptions will be omitted here.

Here, when the engine control CPU 933 and the ID chip 35 are unable to communicate with each other for some reason, if the image forming apparatus 100 performs image formation, information such as the usage history during this time cannot be stored, and the timing for replacing the toner container 32 cannot be accurately managed. Therefore, when the engine control CPU 933 and the ID chip 35 are unable to communicate with each other, the image forming apparatus 100 is caused to stop the image formation in some cases.

However, when image formation by the image forming apparatus 100 is stopped even though the image forming apparatus 100 is capable of performing image formation, the productivity of the image forming apparatus 100 will decrease. Therefore, when a communication abnormality occurs, there are cases where the data to be communicated with the ID chip 35 is temporarily stored in a non-volatile memory such as the HD 909 included in the main unit of the image forming apparatus 100, so that the apparatus is not stopped, thereby preventing the productivity of the image forming apparatus 100 from decreasing.

Note that in the image forming apparatus 100, when the toner amount in the toner container 32 becomes small, the toner container 32 is replaced with a new toner container that is sufficiently filled with toner, or the toner container is refilled with toner. In this case, the toner container 32 is temporarily removed from the main unit of the image forming apparatus 100, and a new toner container or the toner container refilled with toner is mounted to the main unit of the image forming apparatus 100.

As described above, when the toner container 32 is attached to/detached from (attached/detached with respect to) the main unit of the image forming apparatus 100, and the image forming apparatus 100 and the ID chip 35 of the toner container 32 are unable to communicate with each other at the timing when the image forming apparatus 100 attempts to start communicating with the ID chip 35, it is not possible to distinguish between a case where communication is not possible because the toner container 32 is not mounted to the apparatus main unit, or a case where communication is not possible because a communication abnormality has occurred even though the toner container 32 is mounted to the apparatus main unit. Therefore, in the case where the toner container 32 is not mounted to the main unit of the apparatus, the image forming apparatus 100 may attempt to execute image formation even though image formation is not possible, and as a result, an appropriate image cannot be formed and machine trouble may be caused.

Therefore, the image forming apparatus 100 according to the present embodiment has the following functions.

<Functional Configuration of Image Forming Apparatus According to First Embodiment>

Figure 10:
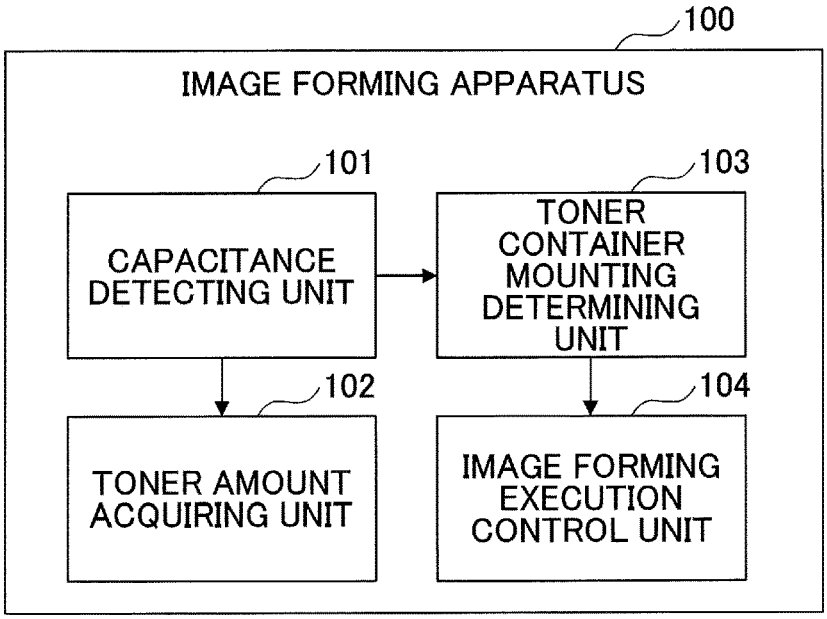
FIG. 10 is a block diagram illustrating an example of a functional configuration of an image forming apparatus according to a first embodiment of the present invention.

The functional configuration of the image forming apparatus 100 will be described with reference to FIG. 10. FIG. 10 is a block diagram illustrating an example of a functional configuration of the image forming apparatus according to the present embodiment.

The image forming apparatus 100 includes a capacitance detecting unit 101, a toner amount acquiring unit 102, a toner container mounting determining unit 103, and an image forming execution control unit 104.

The capacitance detecting unit 101 is implemented by the capacitance detecting circuit 111 and the like, and the capacitance detecting unit 101 detects the capacitance between the parallel plate electrodes 65*a* and 65*b*, and outputs the detected capacitance data to the toner amount acquiring unit 102 and the toner container mounting determining unit 103, respectively.

The toner amount acquiring unit 102 is implemented by the toner amount detecting microcomputer 112 and the like, and the toner amount acquiring unit 102 acquires the toner amount of each toner container 32 of each color based on the capacitance data input from the capacitance detecting unit 101.

The toner container (powder container) mounting determining unit 103 has a function of determining whether the toner container 32 is mounted, based on the capacitance data input from the capacitance detecting unit 101, when communication cannot be performed between the engine control CPU 933 provided in the main unit of the image forming apparatus 100 and the ID chip 35 provided in the toner container 32.

In other words, when the engine control CPU 933 and the ID chip 35 cannot communicate with each other, the toner container mounting determining unit 103 can determine whether the communication is not possible because the toner container 32 is not mounted to the apparatus main unit or the communication is not possible because a communication abnormality has occurred even though the toner container 32 is mounted to the apparatus main unit. The toner container mounting determining unit 103 outputs the determination result to the image forming execution control unit 104.

When the toner container mounting determining unit 103 determines that the toner container 32 is mounted, the image forming execution control unit 104 causes the image forming apparatus 100 to execute image formation. Further, in this case, the image forming execution control unit 104 does not cause the toner amount acquiring unit 102 to write the toner amount data into the ID chip 35.

On the other hand, when the toner container mounting determining unit 103 determines that communication is not possible because the toner container 32 is not mounted to the apparatus main unit, the image forming execution control unit 104 does not cause the image forming apparatus 100 to execute image formation. Further, in this case, the image forming execution control unit 104 causes the toner amount acquiring unit 102 to write the toner amount data into the ID chip 35.

In this way, when the toner container 32 is not mounted to the apparatus main unit, it is possible to prevent the image forming apparatus 100 from executing image formation even though image formation cannot be performed. Note that the toner container mounting determining unit 103 and the image forming execution control unit 104 can be implemented by executing a predetermined program by the engine control CPU 933 and the like.

Here, the determination method for determining, by the toner container mounting determining unit 103, whether the toner container 32 is mounted, is more specifically described.

As described above, the dielectric constant of toner is higher than that of air, and, therefore, when the toner container 32 is mounted to the image forming apparatus 100, the absolute value of the capacitance data between the parallel plate electrodes 65*a* and 65*b* is higher than the absolute value of the capacitance data between the parallel plate electrodes 65*a* and 65*b* in the case where the toner container 32 is not mounted to the image forming apparatus 100.

Therefore, the toner container mounting determining unit 103 can determine that the toner container 32 is mounted to the image forming apparatus 100 when the absolute value of the capacitance data input from the capacitance detecting unit 101 is greater than or equal to a predetermined absolute value threshold. On the other hand, the toner container mounting determining unit 103 determines that the toner container 32 is not mounted to the image forming apparatus 100 when the absolute value of the capacitance data input from the capacitance detecting unit 101 is less than a predetermined absolute value threshold.

The toner container mounting determining unit 103 can output the determination result as described above to the image forming execution control unit 104. Note that the absolute value threshold is determined in advance by experiments and the like and is stored in the HD 909 and the like.

<Operation of Image Forming Apparatus According to First Embodiment>

Figure 11:
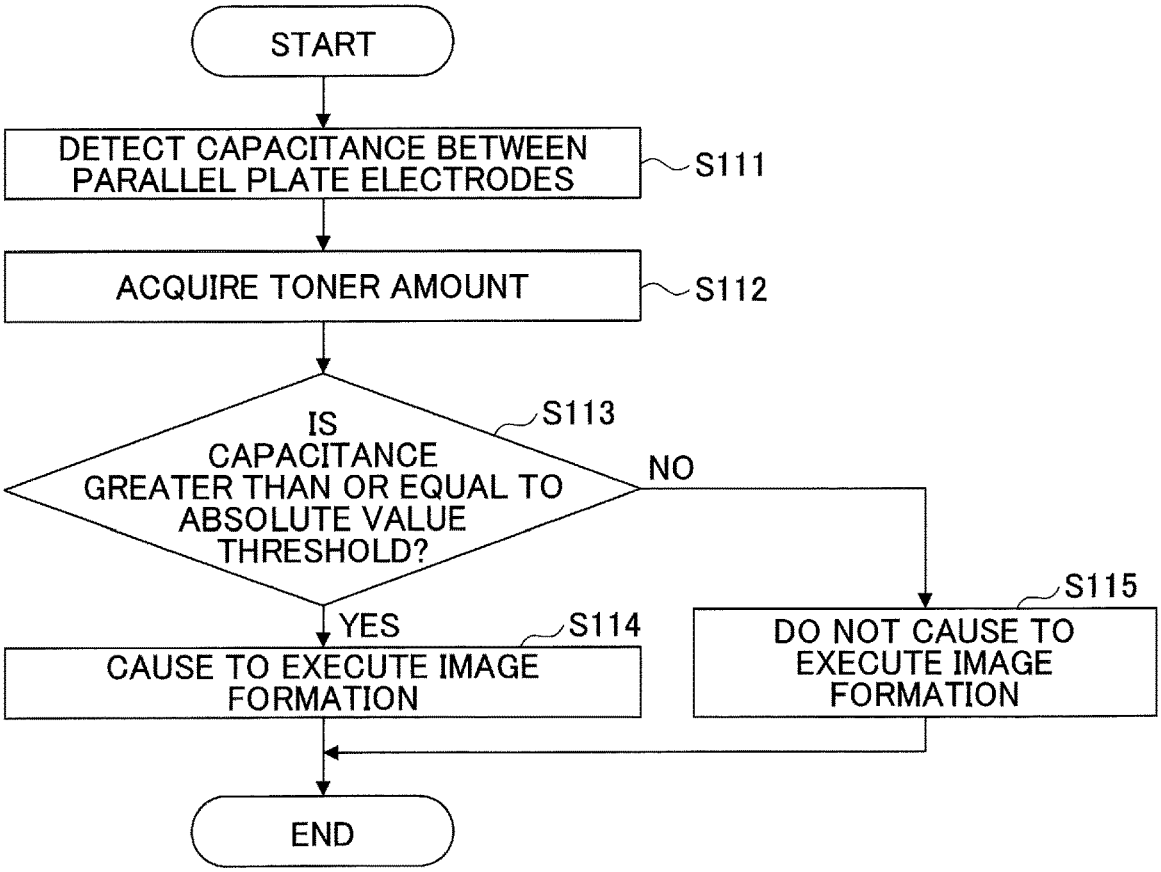
FIG. 11 is a flowchart illustrating an example of an operation of an image forming apparatus according to the first embodiment of the present invention.

FIG. 11 is a flowchart illustrating an example of an operation of the image forming apparatus according to the present embodiment. Note that FIG. 11 illustrates an operation after communication between the engine control CPU 933 and the ID chip 35 is disabled in the image forming apparatus 100.

First, in step S111, the capacitance detecting unit 101 detects the capacitance between the parallel plate electrodes 65*a* and 65*b* and outputs the detected capacitance data to the toner amount acquiring unit 102 and the toner container mounting determining unit 103.

Subsequently, in step S112, the toner amount acquiring unit 102 acquires the toner amount based on the capacitance data input from the capacitance detecting unit 101.

Subsequently, in step S113, the toner container mounting determining unit 103 determines whether the input capacitance data is greater than or equal to a predetermined absolute value threshold.

In step S113, when the toner container mounting determining unit 103 determines that the capacitance data is greater than or equal to the absolute value threshold (YES in step S113), the process proceeds to step S114, and the image forming execution control unit 104 causes the image forming apparatus 100 to execute image formation. Further, at this time, the image forming execution control unit 104 does not cause the toner amount acquiring unit 102 to write the toner amount data into the ID chip 35.

On the other hand, in step S113, when the toner container mounting determining unit 103 determines that the capacitance data is not greater than or equal to the absolute value threshold (NO in step S113), the process proceeds to step S115, and the image forming execution control unit 104 does not cause the image forming apparatus 100 to execute image formation. Further, at this time, the image forming execution control unit 104 causes the toner amount acquiring unit 102 to write the toner amount data into the ID chip 35.

In this manner, when communication between the engine control CPU 933 and the ID chip 35 is not possible, the image forming apparatus 100 can determine whether the toner container 32 is mounted, and execute image formation in accordance with the determination result.

<Effect of First Embodiment>

As described above, in the present embodiment, when communication between the engine control CPU 933 and the ID chip 35 is not possible, the toner container mounting determining unit 103 determines whether the toner container 32 is mounted based on the capacitance detected by the capacitance detecting unit 101. When it is determined that the toner container 32 is mounted, the image forming execution control unit 104 causes the image forming apparatus 100 to execute image formation. Conversely, when it is determined that the toner container 32 is not mounted, the image forming execution control unit 104 does not cause the image forming apparatus 100 to execute image formation. Accordingly, when the toner container 32 is not mounted to the main unit of the image forming apparatus 100, it is possible to prevent the image formation from being executed. Also, even when communication is disabled between the main unit of the image forming apparatus 100 and the ID chip 35, image formation can be executed appropriately.

Second Embodiment

Next, an image forming apparatus according to a second embodiment will be described. Note that descriptions of the same configurations as those of the first embodiment described above will be omitted.

As described above, when the toner amount in the toner container decreases, the toner container is replaced with a new toner container, or toner is refilled into the toner container. Subsequently, the toner container is mounted again to the main unit of the image forming apparatus. At this time, there may be cases where toner, which is different from the genuine, toner (such as toner manufactured by the manufacturer of the image forming apparatus 100), is used as the new toner or the refilled toner.

In this case, the toner container is mounted to the image forming apparatus, and, therefore, the absolute value of the capacitance data is greater than or equal to the absolute value threshold, so image formation is executed. However, because the toner is not genuine toner, even if image formation is executed, the image may not be appropriately formed.

Therefore, an image forming apparatus 100*a* according to the present embodiment has the following functions.

<Functional Configuration of Image Forming Apparatus According to Second Embodiment>

Figure 12:
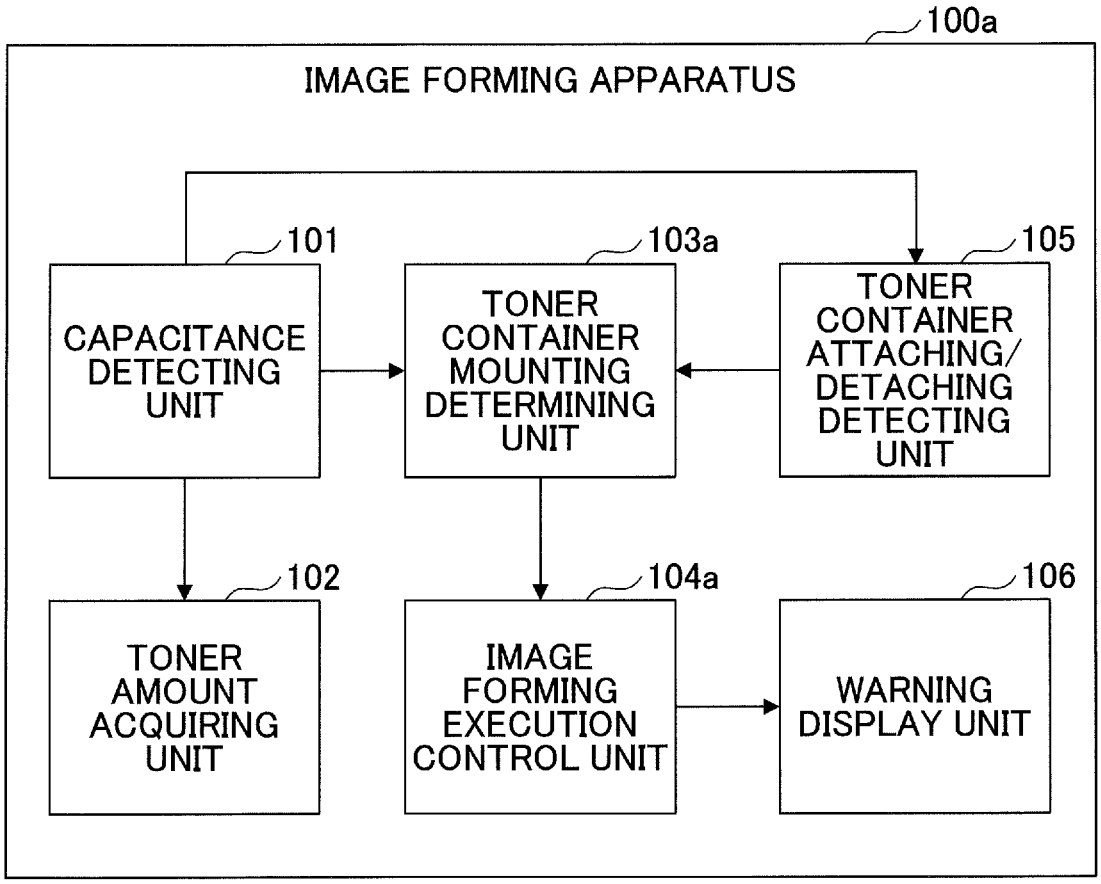
FIG. 12 is a block diagram illustrating an example of a functional configuration of an image forming apparatus according to a second embodiment of the present invention.

FIG. 12 is a block diagram illustrating an example of a functional configuration of an image forming apparatus according to the present embodiment. The image forming apparatus 100*a* includes a toner container attaching/detaching detecting unit 105, a toner container mounting determining unit 103*a*, an image forming execution control unit 104*a*, and a warning display unit 106.

The toner container attaching/detaching detecting unit 105 has a function of detecting that the toner container 32 has been attached to/detached (removed) from the image forming apparatus 100*a*. The toner container attaching/detaching detecting unit 105 is implemented by executing a predetermined program by the engine control CPU 933 and the like.

Here, when the toner container 32 is removed from the image forming apparatus 100*a*, only air is interposed between the parallel plate electrodes 65*a* and 65*b*. Therefore, when the toner container 32 is removed from the image forming apparatus 100*a*, the capacitance between the parallel plate electrodes 65*a* and 65*b* changes significantly compared to when the toner container 32 is mounted.

Accordingly, as an example, the toner container attaching/detaching detecting unit 105 monitors the capacitance data detected by the capacitance detecting unit 101 and detects the attaching/detaching of the toner container 32 when the capacitance significantly changes, such as when the change in the capacitance exceeds a predetermined attaching/detaching threshold. When attaching/detaching of the toner container 32 is detected, the toner container attaching/detaching detecting unit 105 can report this to the toner container mounting determining unit 103*a*.

When communication is disabled between the engine control CPU 933 and the ID chip 35, and the toner container attaching/detaching detecting unit 105 detects attaching/detaching of the toner container 32 with respect to the image forming apparatus 100*a*, the toner container mounting determining unit 103*a* switches the criterion for determining whether the toner container 32 is mounted.

Specifically, when communication is disabled between the engine control CPU 933 and the ID chip 35, the toner container mounting determining unit 103*a* determines that the toner container 32 is mounted, when the toner container attaching/detaching detecting unit 105 has detected the attaching/detaching of the toner container 32 with respect to the image forming apparatus 100*a* but the difference between the capacitance data before the attaching/detaching of the toner container 32 and the capacitance data after the attaching/detaching of the toner container 32 (the difference in the capacitance data before and after the attaching/detaching of the toner container 32) is less than or equal to a predetermined difference value threshold. The difference value threshold is determined in advance by experiments and the like and is stored in HD 909 and the like.

When the difference in the capacitance data before and after the attaching/detaching of the toner container 32 is less than or equal to a predetermined difference value threshold, the toner container mounting determining unit 103*a* can determine that the toner container 32 is mounted to the image forming apparatus 100*a*. Also, the dielectric constant differs depending on the type of toner, and, therefore, if non-genuine toner is included in the mounted toner container, the difference in the capacitance data before and after the attaching/detaching of the toner container 32 will become large. Accordingly, the toner container mounting determining unit 103*a* can determine whether non-genuine toner is included in the toner container 32 based on whether the difference in the capacitance data before and after the attaching/detaching of the toner container 32 is less than or equal to the difference value threshold.

When the toner container mounting determining unit 103*a* determines that the toner container 32 is mounted, the image forming execution control unit 104*a* causes the image forming apparatus 100*a* to execute image formation. On the other hand, when the toner container mounting determining unit 103*a* determines that the toner container 32 is not mounted, the image forming execution control unit 104*a* prevents the image forming apparatus 100*a* from executing image formation and also reports to the warning display unit 106 that the toner container 32 is not mounted.

The warning display unit 106 is implemented by the panel display unit 940*a* and the like, and can display a warning indicating that the toner container 32 is not mounted or that non-genuine toner is used, in response to a report from the image forming execution control unit 104*a*.

On the other hand, when communication is disabled between the engine control CPU 933 and the ID chip 35, but the toner container attaching/detaching detecting unit 105 has not detected the attaching/detaching of the toner container 32 with respect to the image forming apparatus 100*a*, the toner container mounting determining unit 103*a* determines whether the toner container 32 is mounted based on whether the absolute value of the capacitance data is greater than or equal to a predetermined absolute value threshold. In this case, the operations of the toner container mounting determining unit 103*a* and the image forming execution control unit 104*a* are the same as those of the toner container mounting determining unit 103 in the first embodiment, and, therefore, overlapping descriptions will be omitted here.

<Operation of Image Forming Apparatus According to Second Embodiment>

Figure 13:
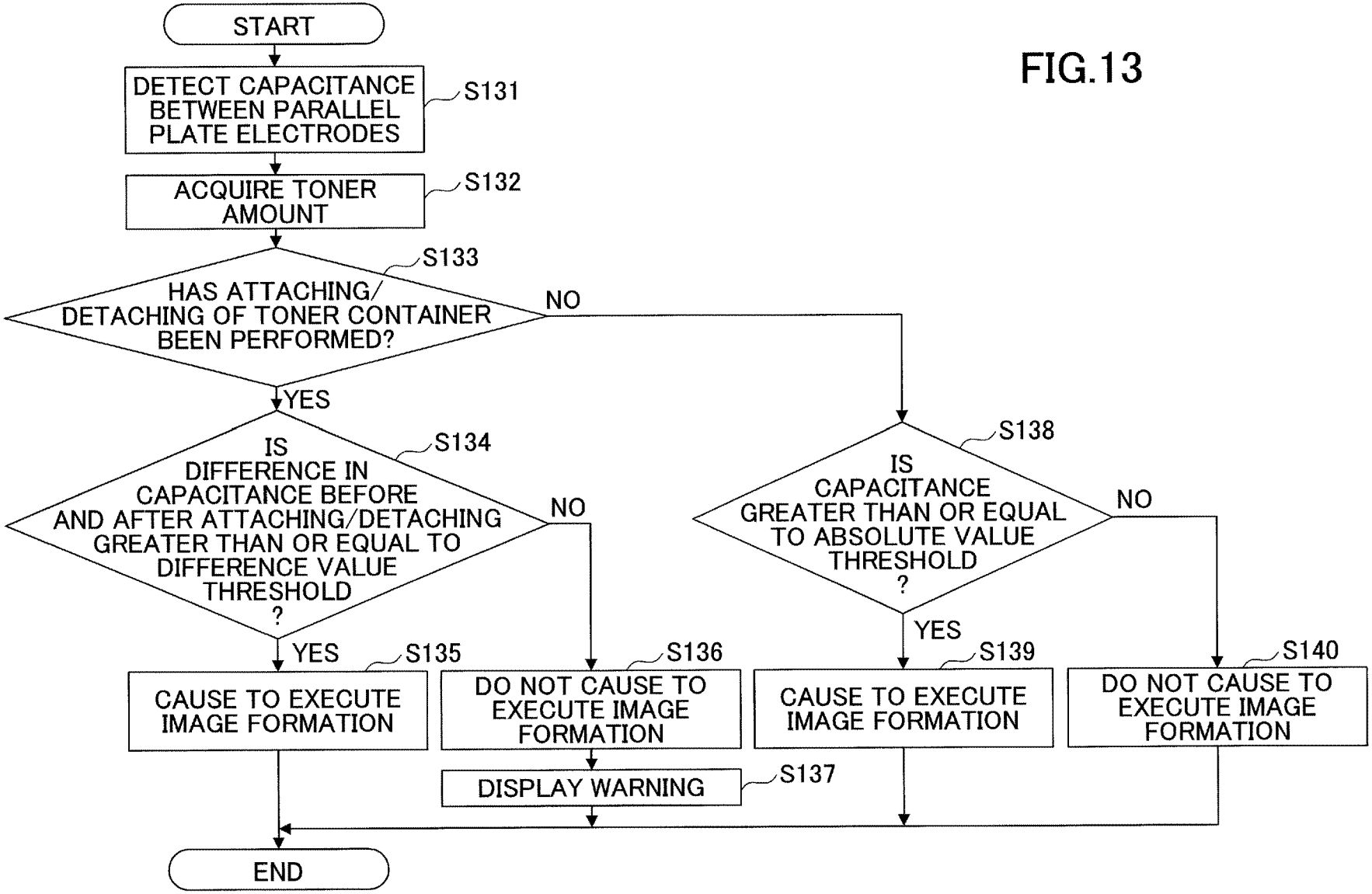
FIG. 13 is a flowchart illustrating an example of an operation of an image forming apparatus according to the second embodiment of the present invention.

FIG. 13 is a flowchart illustrating an example of an operation of the image forming apparatus according to the present embodiment. FIG. 13 illustrates an operation after communication is disabled between the engine control CPU 933 and the ID chip 35 in the image forming apparatus 100*a*. As for the portions overlapping those of FIG. 11, descriptions may be omitted as appropriate.

First, the operations of steps S131 and S132 are the same as the operations of steps S111 and S112 in FIG. 11, and, therefore, the descriptions thereof will be omitted here.

In step S133, the toner container mounting determining unit 103*a* determines whether attaching/detaching of the toner container 32 with respect to the image forming apparatus 100*a* has been performed, according to the detection result of the toner container attaching/detaching detecting unit 105.

In step S133, when the toner container mounting determining unit 103*a* determines that attaching/detaching of the toner container 32 with respect to the image forming apparatus 100*a* has been performed (YES in step S133), the process proceeds to step S134. On the other hand, when the toner container mounting determining unit 103*a* determines that attaching/detaching of the toner container 32 with respect to the image forming apparatus 100*a* has not been performed (NO in step S133), the process proceeds to step S138.

Subsequently, in step S134, the toner container mounting determining unit 103*a* determines whether the difference in the capacitance data before and after the attaching/detaching of the toner container 32 is greater than or equal to the difference value threshold.

In step S134, when the toner container mounting determining unit 103*a* determines that the difference is greater than or equal to the difference value threshold (YES in step S134), in step S135, the image forming execution control unit 104*a* causes the image forming apparatus 100*a* to execute image formation.

On the other hand, in step S134, when the toner container mounting determining unit 103*a* determines that the difference is not greater than or equal to the difference value threshold (NO in step S134), in step S136, the image forming execution control unit 104*a* does not cause the image forming apparatus 100*a* to execute image formation.

Subsequently, in step S137, the warning display unit 106 displays a warning in response to a report from the image forming execution control unit 104*a*.

On the other hand, in step S133, when the toner container mounting determining unit 103*a* determines that attaching/detaching of the toner container 32 with respect to the image forming apparatus 100*a* has not been performed (NO in step S133), the process proceeds to step S138.

The operations of steps S138 through S140 are the same as the operations of steps S113 through S115 in FIG. 11, and, therefore, overlapping descriptions will be omitted here.

In this way, when communication is disabled between the engine control CPU 933 and the ID chip 35, the image forming apparatus 100*a* can determine whether the toner container 32 is mounted and execute image formation in accordance with the determination result.

FIG. 14 is a diagram illustrating an example of a relationship between the communication state of the ID chip 35, a difference (hereinafter, referred to as a difference value) in the capacitance data before and after the attaching/detaching of the toner container 32, and the image forming operation.

In FIG. 14, a case number is indicated in the leftmost column, and in the column further on the right side, the determination result of the communication state of the ID chip 35 is indicated. Further, in the column further on the right side, the difference in the capacitance data before and after the attaching/detaching of the toner container 32 is indicated. Further, in the column further on the right side, the image forming operation of the image forming apparatus 100*a* is indicated.

In the case number "1", the communication state of the ID chip 35 is "communicating" and the difference value is less than or equal to the difference value threshold (±15%), and, therefore, the image forming apparatus 100*a* executes image formation. Further, in the case number "2", the difference value is greater than the difference value threshold (±15%), but the communication state of the ID chip 35 is "communicating", and, therefore, the image forming apparatus 100*a* executes image formation.

In the case number "3", the communication state of the ID chip 35 is "unable to communicate", but the difference value is less than or equal to the difference value threshold (±15%), and, therefore, the image forming apparatus 100*a* executes image formation. In the case number "4", the communication state of the ID chip 35 is "unable to communicate" and the difference value is greater than the difference value threshold (±15%), and, therefore, the image forming apparatus 100*a* does not execute image formation.

Figure 15:
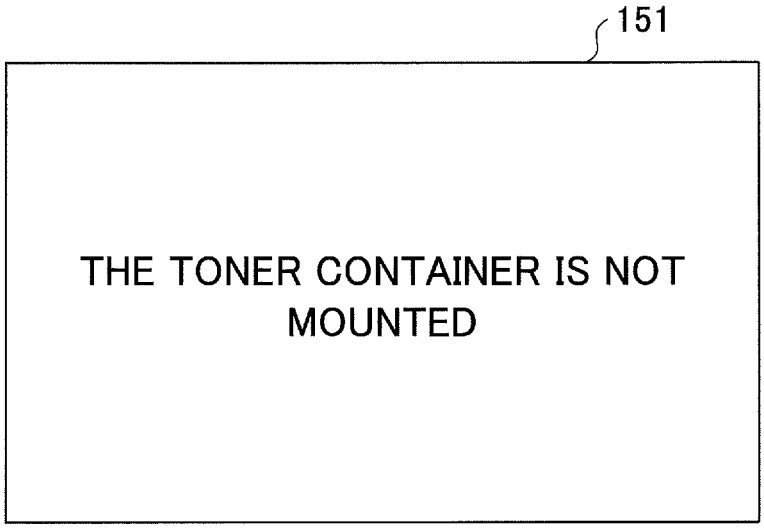
FIG. 15 is a diagram illustrating an example of a display screen displayed by a warning display unit according, to the second embodiment of the present invention.

FIG. 15 illustrates an example of a display screen displayed by the warning display unit 106.

<Effect of Second Embodiment>

As described above, according to the present embodiment, when the toner container 32 is not mounted to the main unit of the image forming apparatus 100, it is possible to prevent image formation from being executed, and even when communication is disabled between the apparatus main unit and the storage medium, image formation can be executed appropriately.

Note that other effects are the same as those described in the first embodiment.

While the embodiments have been described above, the present invention is not limited to the above specifically described embodiments, and various modifications and variations are possible without departing from the scope of the claims.

Embodiments also include an image forming method. For example, the image forming method includes detecting capacitance between two electrodes included in an electrode pair in which the two electrodes are facing each other by interposing a powder container including a storage medium that is communicably coupled to an image forming apparatus; determining whether the powder container is mounted based on the capacitance, upon detecting that communication is not possible between the image forming apparatus and the storage medium; and causing the image forming apparatus to execute image formation, upon determining, at the determining, that the powder container is mounted. By the above image forming method, the same effect as the above-described image forming apparatus can be obtained.

In addition, the embodiments also include a program. For example, the program causes the image forming apparatus to execute a process including detecting capacitance between two electrodes included in an electrode pair in which the two electrodes are facing each other by interposing a powder container including a storage medium that is communicably coupled to an image forming apparatus; determining whether the powder container is mounted based on the capacitance, upon detecting that communication is not possible between the image forming apparatus and the storage medium; and causing the image forming apparatus to execute image formation, upon determining, at the determining, that the powder container is mounted. By the above program, the same effect as the above-described image forming apparatus can be obtained.

According to one embodiment of the present invention, even when the main unit of the apparatus and the storage medium are unable to communicate with each other, image formation can be appropriately executed.

The image forming apparatus, the image forming method, and the recording medium are not limited to the specific embodiments described in the detailed description, and variations and modifications may be made without departing from the spirit and scope of the present invention.

What is claimed is:

1. An image forming apparatus comprising:

an electrode pair including two electrodes facing each other;

a powder container interposed between the two electrodes and including a storage medium that is communicably coupled to the image forming apparatus;

a capacitance detector configured to detect capacitance between the two electrodes;

a powder container mounting determiner configured to determine whether the powder container is mounted to the image forming apparatus based on the capacitance, upon detecting that communication is not possible between the image forming apparatus and the storage medium; and an image forming execution controller configured to cause the image forming apparatus to execute image formation, upon determining, by the powder container mounting determiner, that the powder container is mounted to the image forming apparatus.

2. The image forming apparatus according to claim 1, wherein the powder container mounting determiner determines that the powder container is mounted, upon detecting that an absolute value of the capacitance is greater than or equal to an absolute value threshold that is determined in advance.

3. The image forming apparatus according to claim 1, wherein, upon detecting that communication is not possible between the image forming apparatus and the storage medium, the powder container mounting determiner changes a criterion for determining whether the powder container is mounted, according to a determination result obtained determining whether the powder container has been attached/detached with respect to the image forming apparatus.

4. The image forming apparatus according to claim 3, wherein, in a case where the powder container mounting determiner determines that the powder container has been attached/detached, the powder container mounting determiner determines that the powder container is mounted, upon detecting that a difference in the capacitance before and after the powder container is attached/detached is less than or equal to a difference value threshold that is determined in advance.

5. An image forming method comprising:

detecting capacitance between two electrodes included in an electrode pair in which the two electrodes are facing each other with a powder container interposed between the two electrodes, the powder container including a storage medium that is communicably coupled to an image forming apparatus;

determining whether the powder container is mounted to the image forming apparatus based on the capacitance, upon detecting that communication is not possible between the image forming apparatus and the storage medium; and causing the image forming apparatus to execute image formation, upon determining, at the determining, that the powder container is mounted to the image forming apparatus.

6. The image forming method according to claim 5, wherein the determining includes determining that the powder container is mounted, upon detecting that an absolute value of the capacitance is greater than or equal to an absolute value threshold that is determined in advance.

7. The image forming method according to claim 5, wherein the determining includes, upon detecting that communication is not possible between the image forming apparatus and the storage medium, changing a criterion for determining whether the powder container is mounted, according to a determination result obtained by determining whether the powder container has been attached/detached with respect to the image forming apparatus.

8. The image forming method according to claim 7, wherein the determining includes, in a case where the powder container is determined to have been attached/detached, determining that the powder container is mounted, upon detecting that a difference in the capacitance before and after the powder container is attached/detached is less than or equal to a difference value threshold that is determined in advance.

9. A non-transitory computer-readable recording medium storing a program that causes a computer to execute a process performed in an image forming apparatus, the process comprising:

detecting capacitance between two electrodes included in an electrode pair in which the two electrodes are facing each other with a powder container interposed between the two electrodes, the powder container including a storage medium that is communicably coupled to the image forming apparatus;

determining whether the powder container is mounted to the image forming apparatus based on the capacitance, upon detecting that communication is not possible between the image forming apparatus and the storage medium; and causing the image forming apparatus to execute image formation, upon determining, at the determining, that the powder container is mounted to the image forming apparatus.

10. The non-transitory computer-readable recording medium according to claim 9, wherein the determining includes determining that the powder container is mounted, upon detecting that an absolute value of the capacitance is greater than or equal to an absolute value threshold that is determined in advance.

11. The non-transitory computer-readable recording medium according to claim 9, wherein the determining includes, upon detecting that communication is not possible between the image forming apparatus and the storage medium, changing a criterion for determining whether the powder container is mounted, according to a determination result obtained by determining whether the powder container has been attached/detached with respect to the image forming apparatus.

12. The non-transitory computer-readable recording medium according to claim 11, wherein the determining includes, in a case where the powder container is determined to have been attached/detached, determining that the powder container is mounted, upon detecting that a difference in the capacitance before and after the powder container is attached/detached is less than or equal to a difference value threshold that is determined in advance.

* * * * *